US006882328B2

(12) United States Patent
Araki

(10) Patent No.: US 6,882,328 B2
(45) Date of Patent: Apr. 19, 2005

(54) AC-TYPE PLASMA DISPLAY PANEL AND METHOD FOR DRIVING SAME

(75) Inventor: Kota Araki, Tokyo (JP)

(73) Assignee: NEC Plasma Display Corporation, Tokyo (JP)

( * ) Notice: Subject to any disclaimer, the term of this patent is extended or adjusted under 35 U.S.C. 154(b) by 313 days.

(21) Appl. No.: 10/329,474

(22) Filed: Dec. 27, 2002

(65) Prior Publication Data

US 2003/0122739 A1 Jul. 3, 2003

(30) Foreign Application Priority Data

Dec. 27, 2001 (JP) ..... 2001-398402

(51) Int. Cl.[7] ..... G09G 3/28

(52) U.S. Cl. ..... 345/60; 345/37; 345/63; 345/67; 345/68; 345/77; 345/88; 345/204; 315/169.1; 315/169.4

(58) Field of Search ..... 345/37, 60, 63, 345/67, 68, 77, 88, 204; 315/169.1, 169.4

(56) References Cited

U.S. PATENT DOCUMENTS 6,249,087 B1 * 6/2001 Takayama et al. ..... 315/169.1
2001/0005187 A1 * 6/2001 Lee ..... 345/60
2001/0017519 A1 * 8/2001 Yonehara et al. ..... 313/582
2002/0024303 A1 * 2/2002 Sano et al. ..... 313/582

FOREIGN PATENT DOCUMENTS

JP 2000-123747 A 4/2000
JP 2001-189133 A 7/2001

* cited by examiner

*Primary Examiner*—Bipin Shalwala
*Assistant Examiner*—Vincent E. Kovalick
(74) *Attorney, Agent, or Firm*—Sughrue Mion, PLLC

(57) ABSTRACT

An AC-type plasma display panel and a method for driving the AC-type plasma display panel are provided which are capable of reducing discharge leak (crosstalk) between cells being adjacent to each other and of increasing operating range. The AC-type plasma display panel has two insulating substrates both facing each other. On one insulating substrate is formed a plurality of scanning electrodes and a plurality of sustaining electrodes. On another insulating substrate is formed a plurality of data electrodes. Each of the scanning electrodes is made up of each of bus electrodes and each of main discharge electrodes. Each of the main discharge electrodes has a wide electrode portion arranged on a side of a discharge-space-side between the scanning electrode and the sustaining electrode being adjacent to each other, and a narrow electrode portion arranged on a side of a non-discharge-space between two of the scanning electrodes being adjacent to each other or two of sustaining electrodes being adjacent to each other.

14 Claims, 7 Drawing Sheets

12
2
11
11
2
12
7'
6
7
7
12
12
7'
12
6
7
2
12
6
7
2
6
2

AC-TYPE PLASMA DISPLAY PANEL AND METHOD FOR DRIVING SAME

BACKGROUND OF THE INVENTION

1. Field of the Invention

The present invention relates to an AC-type ((Alternating Current type) plasma display panel (PDP) and a method for driving the AC-type PDP and more particularly to the matrix-type AC-type PDP to perform display in a form of a matrix and the method for driving the matrix-type AC-type PDP.

The present application claims priority of Japanese Patent Application No. 2001-398402 filed on Dec. 27, 2001, which is hereby incorporated by reference.

2. Description of the Related Art

A PDP can be classified from a viewpoint of its structure into two types, one type being a DC (Direct-current)-type PDP in which electrodes are exposed in a discharging gas and another type being an AC (Alternating Current)-type PDP in which electrodes are covered with a dielectric and not exposed directly to the discharging gas. Furthermore, the AC-type PDP can be classified into two types, one type being a memory-operated-type AC-type PDP in which a memory function based on an electric charge accumulating action on the dielectric is used and another being a refresh-operated-type AC-type PDP in which such the memory function is not used.

A generic memory-operated-type and AC-type PDP and its driving method are described by referring to FIG. 8. FIG. 8 is an exploded perspective view of the conventional AC-type PDP. The conventional AC-type PDP shown in FIG. 8 has an insulating substrate 101*a* on a front surface and an insulating substrate 101*b* on a rear surface. On the insulating substrate 101*a* are arranged, at specified intervals, scanning electrodes 109 and sustaining electrodes 110 in parallel to each other and in such a manner that each of the scanning electrodes 109 pairs up with each of the sustaining electrodes 110. Each of the scanning electrodes 109 and each of the sustaining electrodes 110 are made up of a bus electrode 103 to possess electrical conductivity and a main discharge electrode 102 to cause discharge to occur. In FIG. 8, though a transparent electrode is used as the main discharge electrode 102 to prevent a decrease in transmittancy, use of the transparent electrode is not always necessary. The scanning electrodes 109 and sustaining electrodes 110 are covered with a dielectric layer 104*a* on which a protective film 105 made of magnesium oxide is formed that serves to protect the dielectric layer 104*a* from discharging.

On the insulating substrate 101*b* are placed data electrodes 106 in such a manner that each of the data electrodes 106 and each of the scanning electrodes 109 intersect at right angles and that each of the data electrodes 106 and each of the sustaining electrodes 110 also intersect at right angles. The data electrodes 106 are covered with a dielectric layer 104*b*. On the dielectric layer 104*b* are formed first partition walls (ribs) 107 each being used to secure discharging space and to partition a display cell. On the dielectric layer 104*b* on which the first partition walls 107 are not formed and on sides of the first partition walls 107 is applied a phosphor 108 used to convert ultraviolet rays generated by discharge into visible light. By applying the phosphor 108 so as to assign, for example, each color out of three primary colors consisting of a red color, a green color, and a blue color to a different cell, color display can be achieved. Space being put between the insulating substrates 101*a* and 101*b* and being partitioned by each of the first partition walls 107 is hermetically filled with discharging gas selected from the group consisting of helium, neon, xenon, Argon or a like.

FIG. 9A is a plan view of the conventional AC-type PDP when seen from a side of its display surface. Each of the scanning electrodes (Si) 109 and each of the sustaining electrodes (C) 110 are arranged, in parallel to each other and in a row direction, so as to pair up with each other. Out of gaps formed between the scanning electrodes 109 and the sustaining electrodes 110, the gap having a shorter distance is called "discharging space" in which surface discharge occurs between each of the scanning electrodes 109 and each of the sustaining electrodes 110, which makes up a display line. On the other hand, the gap having a larger size and in which discharge does not occur is called "non-discharging space".

Next, a method for driving the conventional memory-operated-type and AC-type PDP is described by referring to FIG. 10. FIG. 10 is a timing chart showing pulses of voltages applied to each electrode which explains driving waveforms employed in the conventional method. In FIG. 10, "Si" denotes one of the scanning electrodes 109 which is scanned "i-th" time. "C" denotes one of the sustaining electrodes 110. "D" denotes one of the data electrodes 106. As shown in FIG. 10, a basic cycle of the driving of the conventional AC-type PDP is made up of an initializing period during which a display cell is initialized to cause discharge to occur readily, a scanning period during which a display cell to be used for displaying is selected, and a sustaining period during which the display cell selected during the scanning period is made to emit light. First, during the initializing period, an erasing pulse is applied to all the scanning electrodes (Si) 109 to stop discharge of a display cell having emitted light due to sustaining discharge before the initializing period shown in FIG. 10, thereby putting all the display cells into an erased state. Next, a pre-discharging pulse is applied to all the scanning electrodes (Si) 109 to cause all the display cells to forcedly emit light and further a pre-discharge erasing pulse is applied to all the scanning electrodes (Si) 109, thereby stopping discharge of all display cells. Such the pre-discharging and pre-discharge erasing operations cause subsequent writing discharge to occur readily.

During the scanning period during which discharge for selection of the display cell occurs, the scanning pulse is sequentially applied to each of the scanning electrodes (Si) 109 by deviating timing with which the scanning pulse is applied and a data pulse is applied, with timing with which the scanning pulse is applied to each of the scanning electrodes (Si) 109, to the data electrodes (D) 106 according to display data. In a display cell to which the data pulse has been applied while the scanning pulse was applied, discharge occurs between each of the scanning electrodes (Si) 109 and each of the data electrodes (D) 106 and the discharge induces another discharge to occur between each of the scanning electrodes (Si) 109 and each of sustaining electrodes (C) 110. A series of these operations is called "writing discharge". When the writing discharge occurs, positive charges are accumulated on the dielectric layer 104*a* on each of the scanning electrodes (Si) 109, negative charges are accumulated on the dielectric layer 104*a* on each of the sustaining electrodes (C) 110 and negative charges are accumulated on the dielectric layer 104*b* on each of the data electrodes (D) 106

During the sustaining period, when the writing discharge occurred during the scanning period and a voltage produced by electric charges accumulated on the dielectric layer 104*a* has been superimposed on a sustaining voltage, surface discharge occurs between each of the scanning electrodes (Si) 109 and each of the sustaining electrodes (C) 110. When the writing discharge does not occur during the scanning period and no wall charges are formed on the dielectric layer 104*a*, the sustaining voltage is set so as not to exceed an initiating voltage at which surface discharge occurs. Therefore, the sustaining discharge required for display occurs only in display cells selected during the scanning period.

When a first-time sustaining discharge occurs, negative charges are accumulated on the dielectric layer 104*a* on the scanning electrodes (Si) 109 and positive charges are accumulated on the dielectric layer 104*a* on the sustaining electrodes (C) 110. A polarity of a voltage of a second-time sustaining pulse to be applied to the scanning electrode (Si) 109 and the sustaining electrode (C) 110 is reverse to a voltage of the first-time sustaining pulse, a voltage produced by charges accumulated on the dielectric layer 104*a* is superimposed on the voltage of the second sustaining pulse, which causes second-time discharge to occur. Thereafter, occurrence of the sustaining discharge continues in the same manner as above. If no surface discharge occurs by the first-time pulse, no discharge occurs by subsequent sustaining pulses.

The above-described three periods including the initializing period, scanning period, and sustaining period makes up one sub-field and an image is displayed by ON/OFF operations in a plurality of the sub-fields. According to the conventional method for driving described above, light-emitting luminance in the conventional AC-type PDP is represented by a product of a number of sustaining pulses, that is, a number of times of light-emission and luminance provided by one-time light-emission during the sustaining period. Therefore, enhancement of the luminance can be achieved by increasing either of the number of times of light-emission or luminance to be produced by one-time light-emission during the sustaining period.

However, since an increase in the number of times of light emission causes the sustaining period to increase, thus tending to shorten the scanning period, there is a limit to the increase. On the other hand, by shortening a width of a sustaining pulse, while a length of the sustaining period is being kept, a number of sustaining pulses can be increased. However, if the pulse width is shortened too much, since formation of the wall charge becomes insufficient, as a result, making it difficult to perform normal light emission, excessive shortening of the pulse width is not allowed. To solve this problem, it is desirous to enhance luminance to be provided by one-time light emission.

One method for enhancing luminance to be provided by one-time light emission is to make large an electrode being used for sustaining discharge which serves to widen the area in which discharge occurs. However, as is apparent from FIG. 9A, it is impossible to make the width wider in a row direction. Though it is possible to extend the width more in a column direction, since non-discharging space becomes narrower, discharge leak (crosstalk) among display cells existing in the column direction tends to readily occur. In some cases, as shown in FIG. 11, erroneous discharge is prevented physically by inserting second partition walls (ribs) 107' into the non-discharge space to form a display cell so as to have a sealed-type structure. FIG. 9B shows a plan view of the conventional AC-type PDP when seen from a side of its display surface. To make narrow the non-discharging space, two pieces of the scanning electrodes (Si, Si+1) 109 and two pieces of the sustaining electrodes C and C are alternately arranged, as shown in FIG. 9C, so that the non-discharging space is put between the scanning electrodes (Si, Si+1) 109 and between the sustaining electrodes (C) 110, thus enabling reduction of electrostatic capacity, which causes a load during the sustaining period, between electrodes. The conventional AC-type PDP having such the display cell structure as described above can be driven by the method shown in FIG. 10.

Next, stability of driving the conventional AC-type PDP during the scanning period is described. During the scanning period, some periods of time are needed before writing discharge occurs after application of the scanning pulse. The time is called "discharging delay time". The discharging delay time is determined, based on various parameters of the conventional AC-type PDP, as a value of probability. An important index representing the discharging delay time includes density of a charged particle, a metastable particle, or a like existing in discharging space. The charged particle and the metastable particle in totality are called as "priming particle". These particles are originally produced when pre-discharge during the initializing period or sustaining discharge occurred. Existence of these particles causes discharge to readily occur and the probability of discharge to increase.

In the driving method shown in FIG. 10, selection of display cells to be used for display is performed, sequentially in order of display lines, on each of display rows during the scanning period.

As a result, if a same sub-field in display cells existing in the column direction is selected, immediately after occurrence of writing discharge, writing discharge occurs also in display cells adjacent to each other in the column direction. A great number of priming particles are produced when writing discharge occurs and, if discharging space portions are connected to each other among display cells existing in the column direction, the priming particles are dispersed into display cells adjacent to the display cell where writing discharge occurred, thereby raising the probability of discharge in display cells adjacent to the display cell where writing discharge occurred. Immediately after the dispersion of priming particles into the display cells, writing discharge occurs in display cells adjacent to the display cell where writing discharge occurred. At this point, the priming particles has not almost decreased in an existing number since no time elapsed after the occurrence of the priming particles and the probability of discharge become very large, which serves to shorten the discharging delay time and thus causes writing discharge to occur in a reliable manner, as a result, preventing a failure in light emission. Therefore, the priming particles produced when writing discharge occurs has a great influence on operations of the conventional AC-type PDP.

If a number of electrodes used to cause sustaining discharge to occur in the column direction is increased, non-discharging space becomes narrow and, as a result, discharge leak occurs in the column direction. At the time of occurrence of writing discharge, since the discharge occurs not only between each of the scanning electrodes 109 and each of the sustaining electrodes (C) 110, but also between each of the scanning electrodes 109 and each of the data electrodes 106, discharge leak tends to occur more often. Moreover, in the conventional AC-type PDP in which two scanning electrodes 109 being adjacent to each other and two sustaining electrodes (C) 110 being adjacent to each other are alternately arranged and a display line is formed by the scanning electrodes 109 and sustaining electrodes (C) 110 being adjacent to each other, during the scanning period, since a scanning pulse is applied only to the scanning electrodes 109 being scanned, a difference in potential is always provided between scanning electrodes 109 being adjacent to each other. However, since the sustaining electrodes (C) 110 are always kept at a same potential and there is no difference in potential between the sustaining electrodes (C) 110 being adjacent to each other, discharge leak tends to occur more often, thus resulting in reduction of operating range.

Therefore, as shown in FIG. 9B and FIG. 9C, by placing the first partition wall in the space, serving as the non-discharging space, between display cells in the column direction to construct the display cell in a sealed form, the discharging space has to be partitioned. However, if such the first partition wall is placed, an area in which light is intercepted increases, as a result, reducing luminance. In this case, since a sealing characteristic of each display cell is large, the priming particles cannot be captured from display cells being adjacent to each other and, even when the display cell is consecutively selected in the column direction, improvement in the discharging delay time cannot be expected, thus causing a failure in lighting in some cases.

Furthermore, before the conventional AC-type PDP is filled with discharging gas, the conventional AC-type PDP has to be evacuated once and unwanted gas has to be exhausted from the PDP. However, since, at the time of the evacuation, exhausting time is determined depending on exhaust conductance, if the conventional AC-type PDP has such the highly-sealed type of cell structure, much time is required for exhausting the unwanted gas.

To solve this problem, a trial to improve operating range by forming a groove in a transverse wall in such a manner to surround a discharging occurring area is disclosed in Japanese Patent Application Laid-open No. 2001-189133. However, an experiment made by the inventors showed that, even when a non-discharging space was made narrow by the disclosed trial, discharge leak was not inhibited sufficiently and operating range is reduced much. Therefore, since the number of electrodes used to cause discharge to occur is not allowed to increase, an increase in luminance was impossible.

Another trial is disclosed in Japanese Patent Application Laid-open No. 2000-123747 in which a protrusion being lower than a first partition wall placed in space between display cells in a column direction is formed. However, this trial presents a problem in that, due to a difference in height of the first partition walls placed in space between display cells, manufacturing processes for forming the first partition walls are made complicated.

SUMMARY OF THE INVENTION

In view of the above, it is an object of the present invention to provide a matrix-type AC-type PDP and a method for driving the matrix-type AC-type PDP which are capable of reducing discharge leak between display cells being adjacent to each other and of increasing operating range. It is another object of the present invention to provide a matrix-type AC-type PDP and the method for driving the matrix-type AC-type PDP which are capable of reducing, even when a partition wall is placed between display cells, an area being light-shielded by the partition wall, thus of achieving high luminance. It is still another object of the present invention to provide a matrix-type AC-type PDP and the method for driving the matrix-type AC-type PDP which are capable of reducing exhaust conductance at a time of manufacturing the matrix-type AC-type PDP.

According to a first aspect of the present invention, there is provided a method for driving a matrix-type AC-type plasma display panel which is constructed by combining a first substrate having a plurality of scanning electrodes and a plurality of sustaining electrodes each extending in parallel to each other in a row direction wherein two of the scanning electrodes being adjacent to each other and two of the sustaining electrodes being adjacent to each other are alternately arranged and wherein a display line is formed between each of the scanning electrodes and each of the sustaining electrodes with a second substrate being placed so as to face a surface of the first substrate on which the scanning electrodes and the sustaining electrodes are formed and having a plurality of data electrodes extending in a column direction being orthogonal to the row direction in which the scanning electrodes and the sustaining electrodes extend and first partition walls used to partition the display line in the column direction with the data electrodes being sandwiched and by forming a plurality of display cells, each of which is placed on each point of intersection of each of the scanning electrodes, each of the sustaining electrodes, and each of the data electrodes, the method including:

a step of setting potentials so that, during a selecting period in which presence or absence of display by the display cell belonging to one of the scanning electrodes, a potential of each of the sustaining electrodes belonging to the one display cell where discharge occurs is made different from a potential of each of the sustaining electrodes in another display cell being adjacent to the one display cell where discharge occurs.

Thus, by making a potential of each of the sustaining electrodes in each of the display cells be different from a potential of each of the sustaining electrodes in each of the display cells being adjacent to each of the display cells where discharge occurs, discharge in the display cells where writing discharge does not expand to the display cells being adjacent to the display cells where writing discharge occurs, which enables discharge leak to be inhibited. As a result, arrangement of wall charges being accumulated in a dielectric layer in display cells being adjacent to the display cells where writing discharge occurs are kept in an unchanged state, the writing discharge in the display cells occurs normally and operating range can be expanded.

In the foregoing, a preferable mode is one wherein, in order to inhibit expansion of discharge occurring between the scanning electrode and the sustaining electrode according to each other, respectively belonging to the display cells arranged on the arbitrary one display line, the potential of the sustaining electrode making up the arbitrary one display line is different from the potential of another sustaining electrode making up another display line being adjacent to the arbitrary one display line.

Also, a preferable mode is one wherein a scanning period during which discharge is caused to occur for selection is separated, in terms of time, from a sustaining period during which discharge is caused to occur for displaying.

By operating above, operating range can be expanded.

Also, a preferable mode is one wherein, during the scanning period, the discharge for selection is caused to occur consecutively in the display lines in order of the display lines.

Also, a preferable mode is one wherein, during the scanning period, the discharge for displaying is caused to occur in the display lines in alternating lines.

By operating above, a charging and discharging current can be reduced, thus enabling an increase in power consumption to be avoided.

Also, a preferable mode is one wherein each of the scanning electrodes has a narrow electrode portion arranged on a side of a non-discharging-space between two of the scanning electrodes being adjacent to each other, and also each of the sustaining electrodes has a narrow electrode portion arranged on a side of a non-discharging-space between two of the sustaining electrodes being adjacent to each other, and wherein a second partition wall is arranged in a non-discharging space in such a manner that the second partition wall is not less than the narrow electrode portion in width is included and that discharging space is not spatially separated in the column direction by the second partition wall.

By operating above, an area where intense discharge occurs can be limited and even if a gap between display lines is narrow, expansion of the discharge between display cells being adjacent to each other can be inhibited. As a result, discharge leak can be prevented and operating range can be expanded.

Also, a preferable mode is one wherein each of the scanning electrodes has a narrow electrode portion arranged on a side of a non-discharging-space between two of the scanning electrodes being adjacent to each other, and also each of the sustaining electrodes has a narrow electrode portion arranged on a side of a non-discharging-space between two of the sustaining electrodes being adjacent to each other, and wherein the narrow electrode portions of the scanning electrode and the sustaining electrode being adjacent to each other, arranged between a pair of the first partition walls are offset each other in the column direction.

Also, a preferable mode is one wherein the scanning electrodes and the sustaining electrodes are so constructed as to cover the data electrodes.

According to a second aspect of the present invention, there is provided a matrix-type AC-type plasma display panel including:

a plurality of scanning electrodes extending in parallel to each other in a row direction;

a plurality of sustaining electrodes arranged in such a manner to be in parallel to the scanning electrodes and which constructs a display line in a gap between each of the sustaining electrodes and each of the scanning electrodes being adjacent to each other;

first partition walls to partition the display line in a column direction; and wherein each of the scanning electrodes and each of the sustaining electrodes has a narrow electrode portion, and wherein a second partition wall is placed between two of the narrow electrode portions adjacent to each other within a non-discharging space in such a manner that discharging space is not spatially separated in the column direction.

Also, according to a third aspect of the present invention, there is provided a matrix-type AC-type plasma display panel includes:

a first substrate and a second substrate being placed so as to face each other;

a plurality of scanning electrodes each being placed on a surface of the first substrate which faces the second substrate and extending in parallel to each other in the row direction;

a plurality of sustaining electrodes arranged in such a manner to be in parallel to the scanning electrodes and each constructing a display line in a gap between each of the sustaining electrodes and each of the scanning electrodes both being adjacent to each other;

a plurality of data electrodes being placed on a surface of the second substrate which faces the first substrate and extending in the column direction orthogonal to a direction in which each of the scanning electrodes and each of the sustaining electrodes extend;

first partition walls used to partition the display line in the column direction;

a plurality of display cells, each of which is placed at each point of intersection of each of the scanning electrodes, each of the sustaining electrodes, and each of data electrodes; and second partition walls being placed between the display lines in such a manner to cover each of the data electrodes.

By configuring above, an area where intense discharge occurs can be limited and even if a gap between display lines is narrow, expansion of the discharge between display cells being adjacent to each other can be inhibited. As a result, discharge leak can be prevented and operating range can be expanded. Moreover, expansion of the discharge between cells being adjacent to each other can be inhibited. Also, unlike in the case where the display cell is constructed to be of a sealed type by the second partition walls in the row direction, interception of light caused by the second partition wall is relieved, thus improving luminance Also, unlike in the case where the display cell is constructed so as to have the sealed structure, according to the present invention, it is possible to capture priming particles from cells being adjacent to each other. As a result, discharging delay time required when writing discharge occurs in display cells being adjacent to each other in the column direction and being higher in scanning order can be shortened more compared with the case where display cells being adjacent to each other in the column direction and being higher in scanning order are not selected. Also, since the discharging space is connected by the gap in the column direction, exhaust conductance is improved and, as a result, exhaust time is shortened. Furthermore, by covering the data electrodes with the second partition walls, expansion of discharge to adjacent display cells can be prevented.

In the foregoing third and fourth aspects, a preferable mode is one wherein one sustaining electrode is provided for every other scanning electrode.

Furthermore, a preferable mode is one wherein two of scanning electrodes being adjacent to each other and two of sustaining electrodes being adjacent to each other are alternately formed.

With the above configurations, during the scanning period in which presence or absence of display to be performed by the display cell belonging to one of the scanning electrodes is controlled, by setting potentials so that a potential of each of the sustaining electrodes belonging to the display cell is made different from a potential of each of the sustaining electrodes in display cells being adjacent to the display cell in which display is being done, expansion of discharge can be inhibited even when an interval between display lines is narrow and, as a result, discharge leak can be reduced and proper occurrence of writing discharge is made possible even between display cells being adjacent to each other and operating range of the PDP is expanded.

Moreover, since each of the scanning electrodes and of the sustaining electrodes has a discharging-space-side width increasing section and a non-discharging-space-side width decreasing section and the discharging-space-side width increasing sections face each other, areas where discharge expands can be limited in a boundary portion between display cells being adjacent to each other and regions where intense discharge occurs can be separated between display cells being adjacent to each other with the non-discharging space being sandwiched, which serve to inhibit discharge leak between display cells being adjacent to each other and to expand operating range of the AC-type PDP.

BRIEF DESCRIPTION OF THE DRAWINGS

The above and other objects, advantages, and features of the present invention will be more apparent from the following description taken in conjunction with the accompanying drawings in which:

FIGS. 4A and 4B are diagrams showing results of expansion of operating range of the Matrix-type AC-type PDP, in which FIG. 4A shows a result obtained by the driving method employed in the first embodiment of the present invention and FIG. 4B shows a result obtained by a driving method employed in the second embodiment of the present invention;

FIGS. 7A, 7B, and 7C are partial plan views of the Matrix-type AC-type PDP in which discharging space is not separated in a column direction obtained when seen from a side of its display face in which; FIG. 7A is a partial plan view of the Matrix-type AC-type PDP in which main discharge electrodes each having a restriction portion are provided and a second partition wall is placed in non-charging space in such a manner that a width of the restriction portion is included, FIG. 7B is a partial plan view of the AV-type PDP in which main discharge electrodes each having a restriction portion are provided and a second partition wall placed in non-charging space in such a manner so as to include a restriction space is integrated into a first partition wall being separated in the column direction, FIG. 7C is a partial plan view of the Matrix-type AC-type PDP in which main discharge electrodes each having a restriction portion are provided and a second partition wall placed in non-charging space in such a manner so as to include a restriction space is integrated into a first partition wall being separated in the column direction and data electrodes are covered by the first partition wall in the non-discharging space, FIG. 7D is a partial plan view of the Matrix-type AC-type PDP in which main discharge electrodes are placed in such a manner that non-discharging space is sandwiched between the main discharge electrodes and its restriction portions are not overlapped in the column direction, and FIG. 7E is a partial plan view of the Matrix-type AC-type PDP in which data electrodes are placed along restriction portions in such a manner that non-discharging space is sandwiched between the data electrodes and in such a manner that restriction portions are not overlapped in the column direction;

FIG. 9A shows a case where the non-discharging space is constructed so as to be large, FIG. 9B shows a case where the non-discharging space is constructed to be made narrow and the first partition wall is provided to form a hermetically sealed structure, and FIG. 9C shows a case where two scanning electrodes being adjacent to each other and two sustaining electrodes being adjacent to each other are alternately placed and the non-discharging space is constructed to be made narrow and the first partition wall is provided to form a hermetically sealed structure;

DETAILED DESCRIPTION OF THE PREFERRED EMBODIMENTS

Best modes of carrying out the present invention will be described in further detail using various embodiments with reference to the accompanying drawings.

First Embodiment

Figure 1:
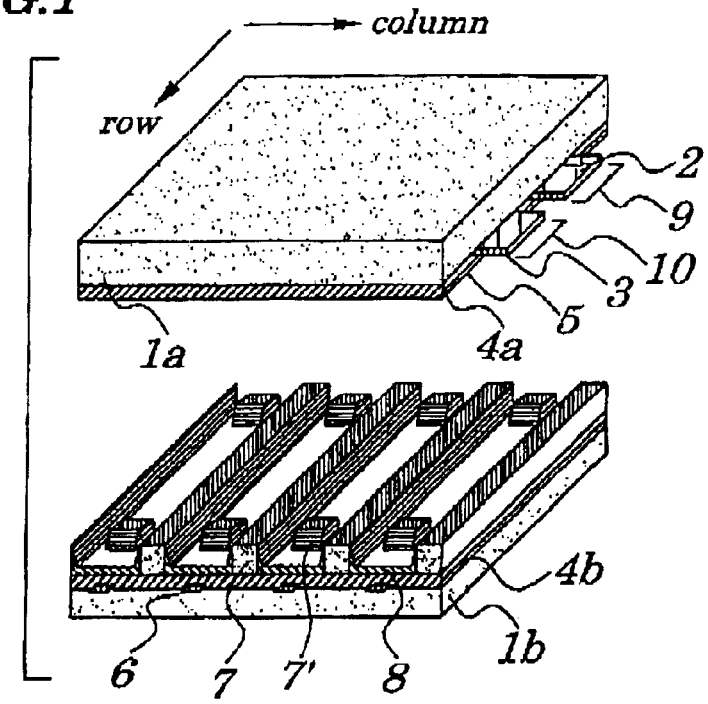
FIG. 1 is an exploded perspective view of a matrix-type AC-type PDP according to first and second embodiments of the present invention.
Figure 2:
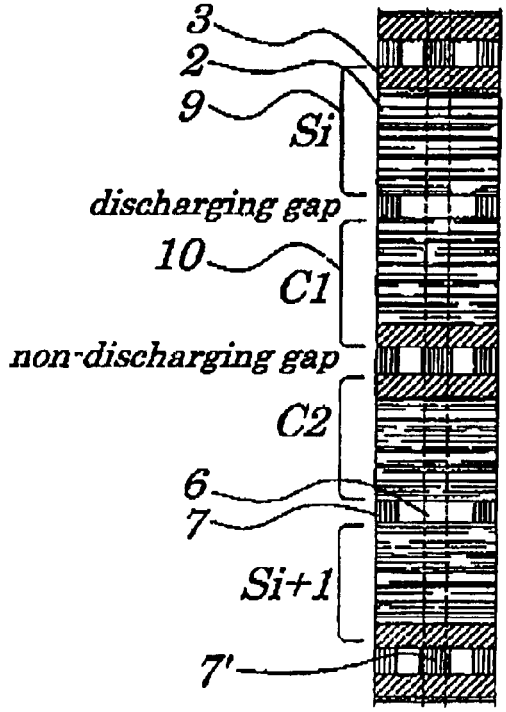
FIG. 2 is a plan view of the matrix-type AC-type PDP of FIG. 1 obtained when seen from a side of its display face.

FIG. 1 is an exploded perspective view of a matrix-type AC-type POP according to first and second embodiments of the present invention. FIG. 2 is a plan view of the matrix-type AC-type PDP of FIG. 2 obtained when seen from a side of its display face. The matrix-type AC-type PDP shown in FIG. 1 and FIG. 2 is constructed in such a manner that an insulating substrate 1*a* faces an insulating substrate 1*b*. On the insulating substrate 1*a* are placed a plurality of scanning electrodes 9 and a plurality of sustaining electrodes 10 extending toward a row direction at specified intervals and in parallel to each other, and in such a manner that two scanning electrodes 9 being adjacent to each other and two sustaining electrodes 10 being adjacent to each other are alternately arranged. Each of the scanning electrodes 9 and of the sustaining electrodes 10 is made up of a bus electrode 3 used to secure its electrical conductivity in the row direction and a main discharge electrode 2 used to cause discharge to occur. Space between each of the scanning electrodes 9 and of the sustaining electrodes 10 is used as discharging space. Space between the scanning electrodes 9 and space between the sustaining electrodes 10 serve as non-charging space.

The scanning electrodes 9 and the sustaining electrodes 10 are covered with a dielectric layer 4*a* and, in order to protect the dielectric layer 4*a* from discharge, a protecting film 5 made of magnesium oxide or a like is formed on the dielectric layer 4*a*. On the other hand, on the insulating substrate 1*b* are placed data electrodes 6 in such a manner that each of the data electrodes 6 and each of the scanning electrodes 9 intersect at right angles and that each of the data electrodes 6 and each of the sustaining electrodes 10 intersect at right angles. The data electrodes 6 are covered with a dielectric layer 4*b* and on the dielectric layer 4*b* are formed first partition walls 7 so as to extend in a column direction which are used to secure discharging space between the insulating substrates 1*a* and 1*b* and to partition a display cell. Moreover, as shown in FIG. 1, in the non-discharging space, second partition walls 7' are arranged in such a manner that a gap between two of the first partition walls 7 being placed in the column direction and adjacent to each other is provided. On the dielectric layer 4*b* on which the first partition walls 7 and second partition walls 7' are not formed, on side faces of the first partition walls 7, and on side faces of the second partition walls 7' being arranged in the non-discharging space is applied a phosphor B used to convert ultraviolet rays generated by discharge into visible light. Space being put between the insulating substrates 1*a* and 1*b* and being partitioned by each of the first partition walls 7 is hermetically filled with a discharging gas selected from the group consisting of helium, neon, xenon, Argon or a like.

Figure 3:
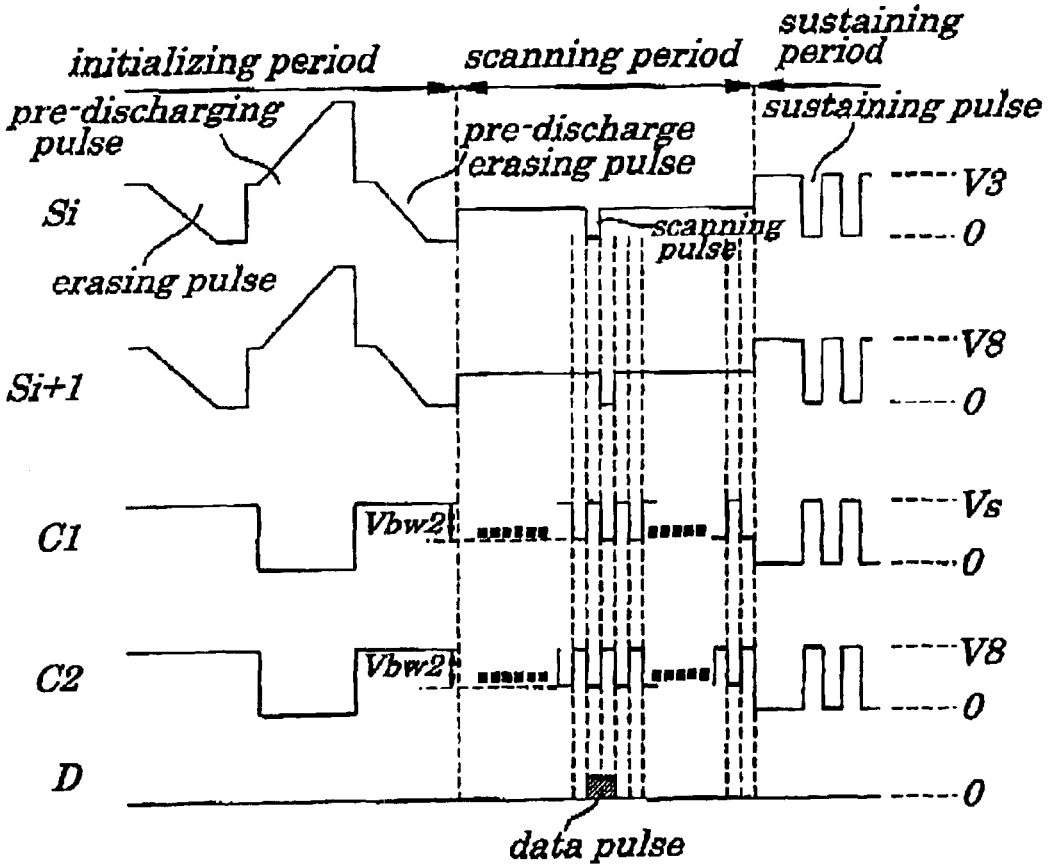
FIG. 3 is a diagram showing driving waveforms employed in a method for driving the Matrix-type AC-type PDP of FIG. 1 according to the first embodiments of the present invention.

FIG. 3 is a diagram showing driving waveforms employed in a method for driving the matrix-type AC-type PDP according to the first embodiment of the present invention. In FIG. 3, "Si" denotes the "i-th" scanning electrode 9. "Si+1" denotes the "i+1-th" scanning electrode 9. "C1" denotes one sustaining electrode 10 which makes up the display cell together with the "i-th" scanning electrode (C1) 9. "C2" denotes one sustaining electrode 10 which makes up the display cell together with the "i+1-th" scanning electrode (Si+1) 9. If "i" is an odd number, "C2" corresponds to an odd row and "C1" corresponds to an even row. "D" denotes one of the data electrodes 6.

First, during the initializing period, an erasing pulse is applied to all the scanning electrodes 9 to stop discharge of the display cell that emitted light due to sustaining discharge in a previous period as not shown in FIG. 3 and to put all display cells into an erased state. Next, a pre-discharging pulse is applied to all the scanning electrodes 9 to forcedly cause discharge to occur in all display cells and then a pre-discharge erasing pulse is applied to all the scanning electrodes 9 to stop discharge in all display cells. Such pre-discharge and pre-discharge erasing operations serve to make a later writing discharge to occur easier.

During the scanning period during which discharge for selection of the display cell occurs, a scanning pulse is sequentially applied to each of the scanning electrodes 9 by deviating timing with which the above scanning pulse is applied and a data pulse is applied, with timing with which the scanning pulse is applied to each of the scanning electrodes, to the data electrodes (D) 6 according to display data. While the "i-th" scanning electrode (Si) 9 is being scanned, a voltage to be applied to the sustaining electrode (C1) 10 which makes up a display cell together with the above "i-th" scanning electrode (Si) 9 is the same value as in the conventional case shown in FIG. 10. However, a voltage to be applied to the sustaining electrode (C2) 10 being adjacent to the sustaining electrode (C1) 10 becomes lower by "Vbw2" as shown in FIG. 3. At this time, if a data pulse had been applied when a scanning pulse was fed, discharge occurs between the scanning electrode (Si) 9 and the data electrode (D) 6 and also discharge occurs between the scanning electrode (Si) 9 and the sustaining electrode (C1) 10 by induction of the discharge occurring between the above scanning electrode (Si) 9 and the data electrode (D) 6. When the "i+1"-th scanning electrode (Si+1) 9 is being scanned, a voltage to be applied to the sustaining electrode (C2) 10 which makes up the display cell together with the scanning electrode (Si−1) 9 is the same as in the conventional case shown in FIG. 10. However, a voltage to be applied to the sustaining electrode (C1) 10 being adjacent to the sustaining electrode (C2) 10 becomes lower by Vbw2.

When writing discharge occurs, positive charges are accumulated on the surface of the dielectric layer 4*a* over the scanning electrodes 9, negative charges on the surface of the dielectric layer 4*a* over the sustaining electrodes 10, and negative charges on the surface of the dielectric layer 4*b* over the data electrodes (D) 6 and a display cell is selected. In the selected display cell, discharge occurs every time a sustaining pulse is applied during the sustaining period and light emission for display can be achieved.

Figure 4A:
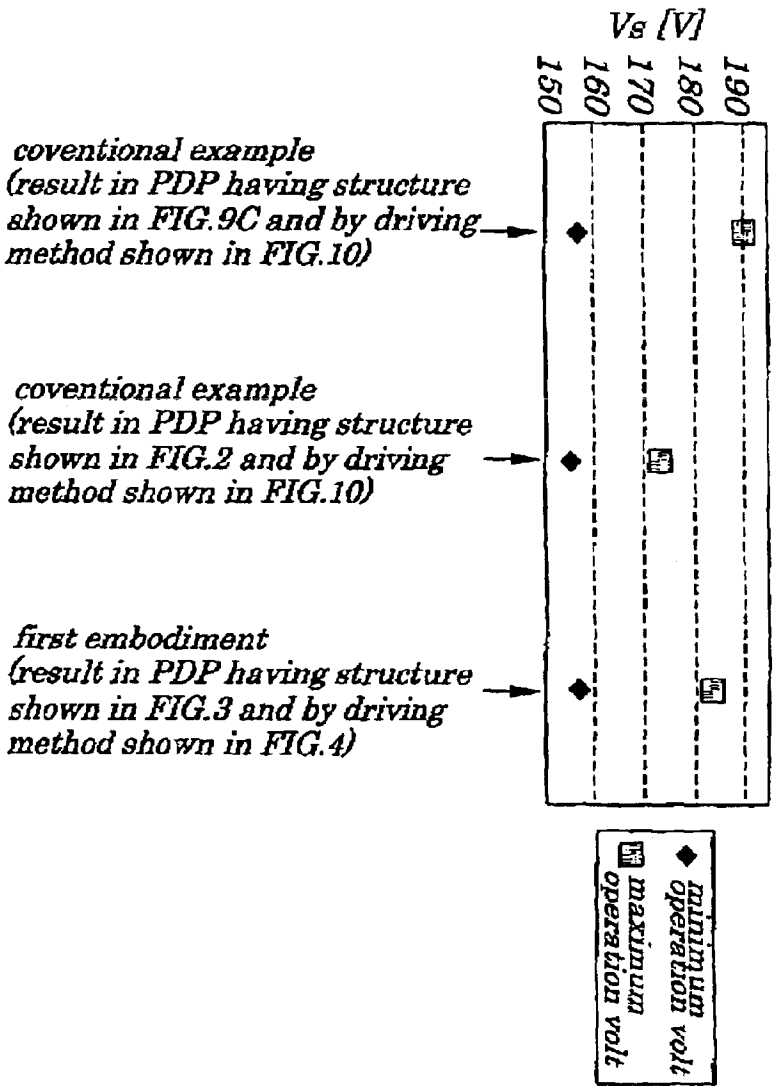
Figure 10:
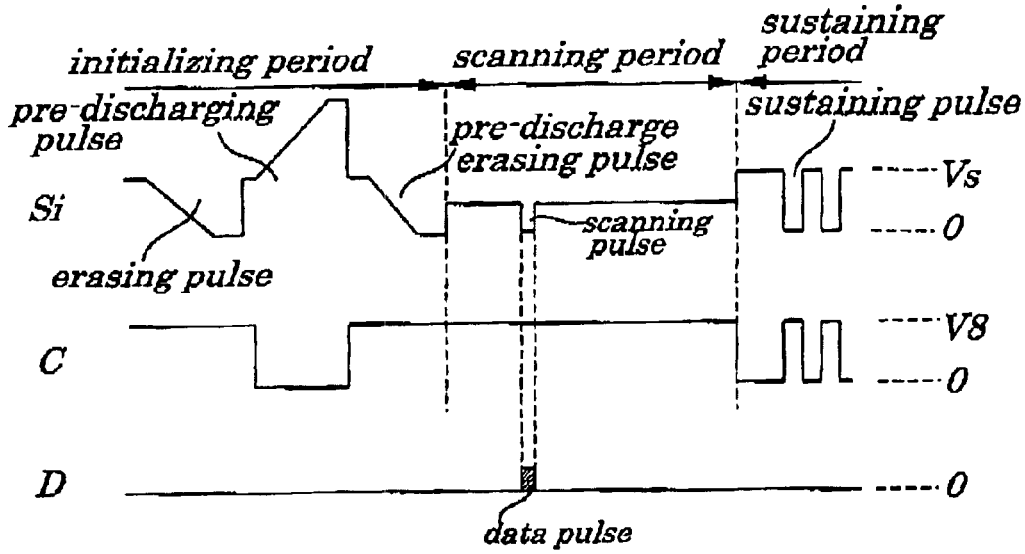
FIG. 10 (PRIOR ART)
FIG. 10 is a timing chart showing pulses of voltages applied to each electrode explaining driving waveforms employed in a conventional method.
Figure 11:
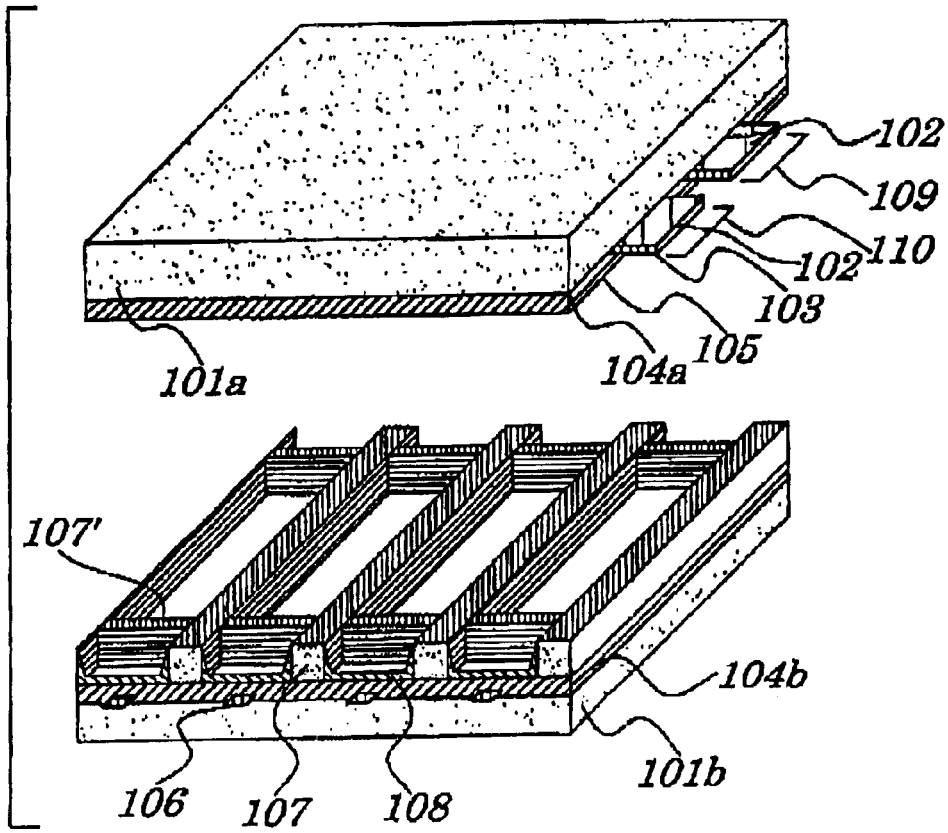
FIG. 11 (PRIOR ART)
FIG. 11 is a diagram illustrating another conventional Matrix-type AC-type PDP when seen from a side of its display face.

Operating range (margin) of the matrix-type AC-type PDP obtained by the driving method of the present invention, as shown in FIG. 4A, is from 157 V to 184 V. The resulting operating range has been improved by about 10 V when compared with the operating range obtained by the conventional driving method shown in FIG. 10 which ranged from 155 V to 174 V. These results are due to the facts that, in the driving method shown in FIG. 10, discharge leak caused by writing discharge occurs in display cells being adjacent to each other, through a groove portion which connects the second partition walls 7' provided in the non-discharging space to the discharging space in the display cells existing in the column direction between the first partition walls 7 in the column direction. Writing discharge occurs also between each of the scanning electrodes 9 and each of the sustaining electrodes 10 by induction of the discharge occurring between each of the scanning electrodes 9 and each of the data electrodes 6. At this time, since a scanning pulse has been applied to display cells in which writing discharge had occurred and a scanning pulse has not been applied to each of the scanning electrodes 9 in each of the display cells being adjacent to the display cells in which the writing discharge had occurred, a difference in potential between display cells in which the scanning electrodes 9 are adjacent to each other is provided and therefore the discharge does not expand easily. However, if the conventional driving method shown in FIG. 10 is employed, since sustaining electrodes 110 are kept at a same voltage, no difference in potential exists between the sustaining electrodes 110 being adjacent to each other. As a result, discharge expands in display cells being adjacent to each other in the non-discharging space sandwiched between the sustaining electrodes 110, thus causing the discharge leak. Since the occurrence of discharge leak causes a change in arrangements of wall charges accumulated on the dielectric layer 104*a* in the display cells being adjacent to the display cell where writing charge occurred, writing discharge would not occur and, as a result, operating range is reduced.

To solve this problem, according to the present invention, in display cells in which writing discharge occurs, a voltage to be applied to the sustaining electrodes 10 is the same as that has been applied conventionally, however, a voltage to be applied to the sustaining electrodes 10 in the display cell being adjacent to the above display cell where the writing discharge occurs is made lower than that has been applied conventionally, that is, than the voltage to be applied to the sustaining electrodes 10 in the display cells where the writing discharge occurs. By operating as above, since a difference in potential between the sustaining electrodes 10 being adjacent to each other is provided, that is, a potential between the sustaining electrodes 10 being adjacent to each other is different, expansion of the discharge from the display cells where the writing discharge occurs to another display cell being adjacent to the display cell where the writing discharge occurs can be prevented, thereby reducing the discharge leak. As a result, arrangements of wall charges accumulated on the dielectric layer 4*a* in display cells being adjacent to each other can be made unchangeable and the writing discharge occurs also normally in display cells being adjacent to each other and therefore operating range is expanded.

Referring again to FIG. 1 and FIG. 2, the second partition walls 7' are so placed that there is a gap between each of the first partition walls 7 and each of the second partition walls 7'. Therefore, unlike in the case where the display cells are so constructed as to be of a sealed-type by using the second partition walls 7' existing in the row direction, interception of light caused by the second partition walls 7' is relieved, thus enhancing luminance.

Moreover, in the case where the matrix-type AC-type PDP has a structure of the sealed-type, since almost no priming particles can be captured, the discharging delay time occurring even when display cells being adjacent to each other in the column direction and being higher in scanning order are selected is shortened only by about 0.8 times, unlike in the case where display cells being adjacent to each other in the column direction and being higher in scanning order are not selected. However, according to the present invention, since the connection between the discharging space in the column direction is established, the priming particles from display cells being adjacent to each other and being higher in scanning order can be captured and therefore the discharging delay time occurring when the writing discharge occurs in display cells being adjacent to each other in the column direction and being higher in scanning order is shortened by about 0.5 times, unlike in the case where display cells being adjacent to each other in the column direction and being higher in scanning order are not selected.

Moreover, since the discharging space is connected by a gap in the column direction, exhaust conductance is improved and, as a result, exhaust time is shortened.

Also, since a height of each of the first partition walls 7 in the column direction may be so configured as to be same as that of each of the second partition walls 7' in the row direction, one-time formation of the first partition walls 7 and the second partition walls 7' is possible in its manufacturing processes and its manufacturing costs are same as in the conventional case.

Also, the intense writing discharge occurs even between each of the scanning electrodes 9 and each of the data electrodes 6 and, therefore, as shown in FIG. 2, discharge leak can be controlled by placing the second partition walls 7' formed in the non-discharging space in such a manner as to cover the data electrodes 6.

Second Embodiment

Configurations of a matrix-type AC-type PDP of a second embodiment are same as those in the first embodiment and are, therefore, described by referring to FIG. 1 and, to FIG. 2 which is a plan view of the matrix-type AC-type PDP.

Figure 5:
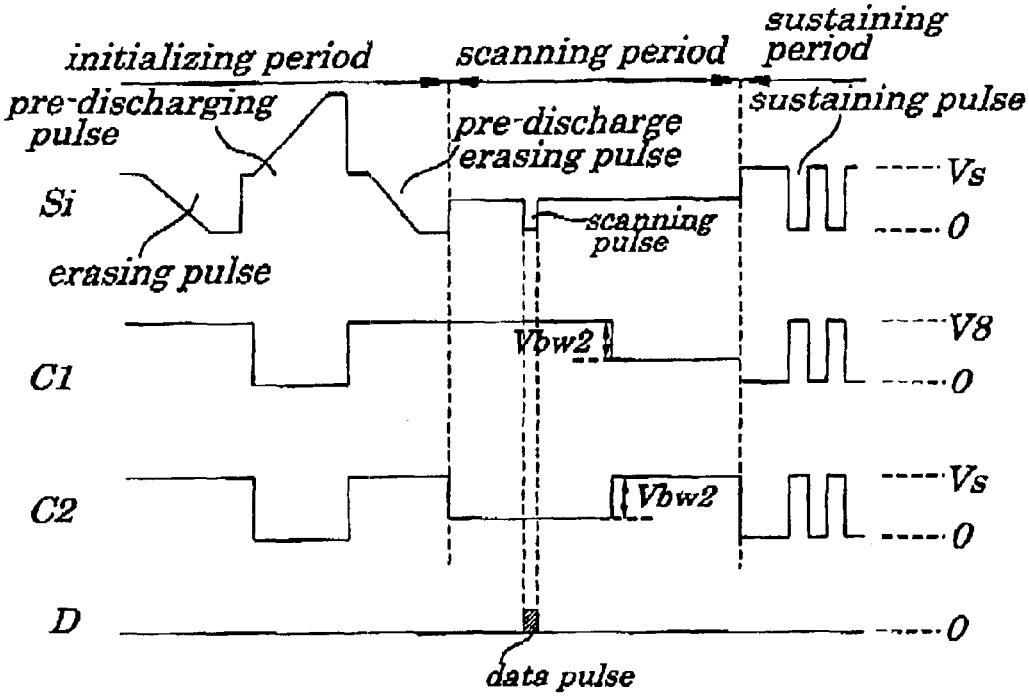
FIG. 5 is a showing driving waveforms employed in the method for driving the Matrix-type AC-type PDP of the second embodiment of the present invention.

A method for driving the matrix-type AC-type PDP of the second embodiment is explained by referring to FIG. 5. As in the case of the first embodiment, an initializing period is first provided during which all display cells are initialized and the matrix-type AC-type PDP is put in a state where writing discharge readily occurs during a scanning period to follow. During the scanning period, scanning is performed on every other line, that is, separately on an odd line and an even line by dividing the scanning period into two lines. When the scanning is performed on the odd line, though a voltage of a sustaining electrode (C1) 10 on the odd line is made the same as that shown in the conventional example in FIG. 10, a voltage of a sustaining electrode (C2) 10 being adjacent to the sustaining electrode (C1) 10 is lowered by Vbw2. When the scanning is performed on the even line, though a voltage of the sustaining electrode (C2) 10 on the even line is made the same as that shown in the conventional example shown in FIG. 10, a voltage of the sustaining electrode (C1) 10 being adjacent to the sustaining electrode (C2) 10 is lowered by Vbw2. In the operations as above, as in the case of the first embodiment, discharge leak caused by discharge in a non-discharging space sandwiched between the sustaining electrodes (C1, C2) 10 can be inhibited by providing a difference in potential between the sustaining electrodes (C1, C2) 10 being adjacent to each other.

In driving waveforms employed in the first embodiment, scanning is performed consecutively in order of lines and a potential of the sustaining electrode (C1) 10 is changed every other line and therefore charging and discharging currents are produced in the matrix-type AC-type PDP, as a result, causing an increase in power consumption. However, in the second embodiment, the scanning period is divided into two and in each of the divided scanning periods, the scanning is performed separately on an odd line and on an even line and, therefore, a change in potential occurs only once and, thus, required charging and discharging currents can be reduced and an increase in power consumption can be avoided. Since the scanning is performed on every other line, priming particles produced by writing discharge in display cells being adjacent to each other can not be captured. However, if the discharging space in display cells in a column direction is sufficiently connected to each other, a rise in the probability in occurrence of discharge can be expected even by priming particles being produced by discharge in a display cell existing apart by one.

Third Embodiment

Figure 6:
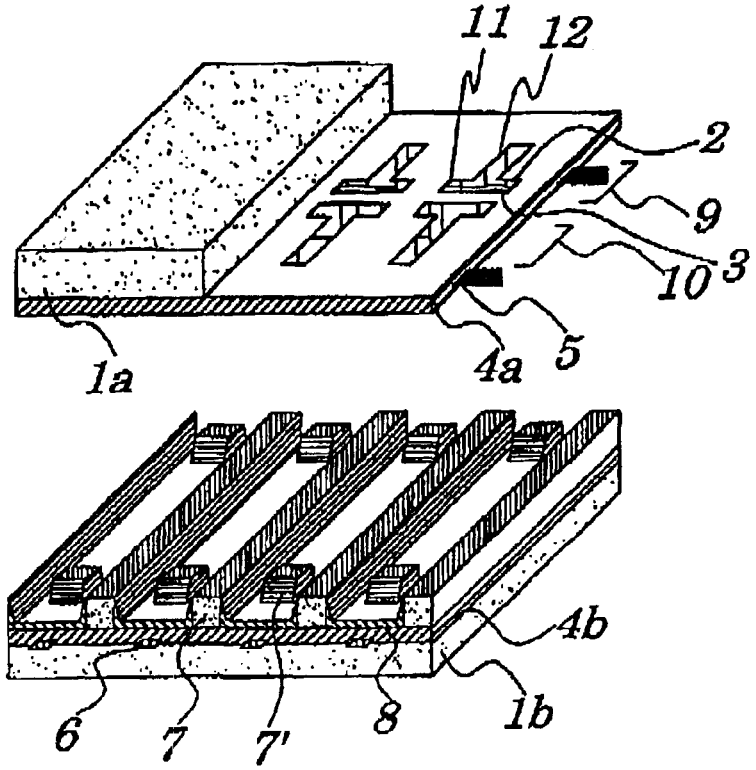
FIG. 6 is an exploded perspective view of the Matrix-type AC-type PDP according to first and second embodiments of the present invention.
Figures 7A, 7B, 7C, 7D, 7E:
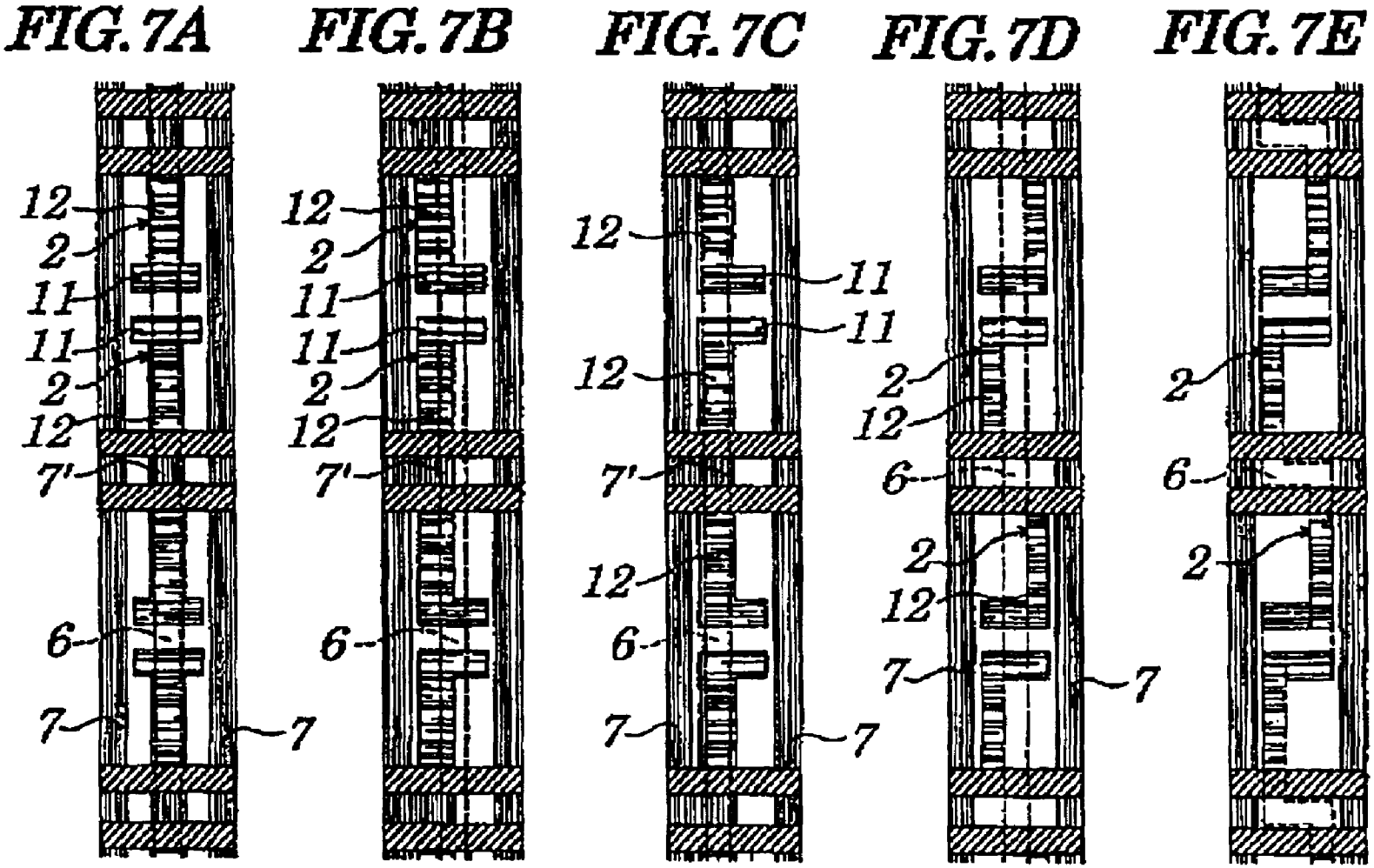
Figure 8:
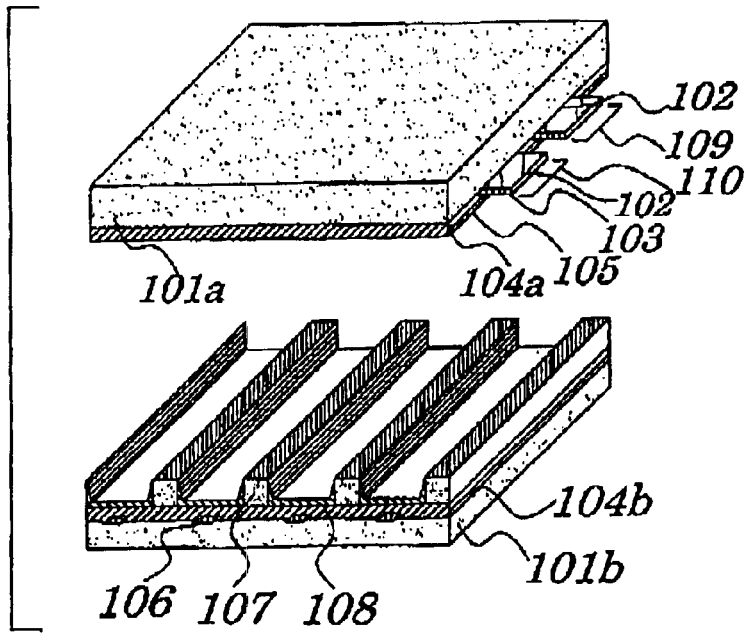
FIG.8 (PRIOR ART)
FIG. 8 is an exploded perspective view of a conventional Matrix-type AC-type PDP.
Figure 9A:
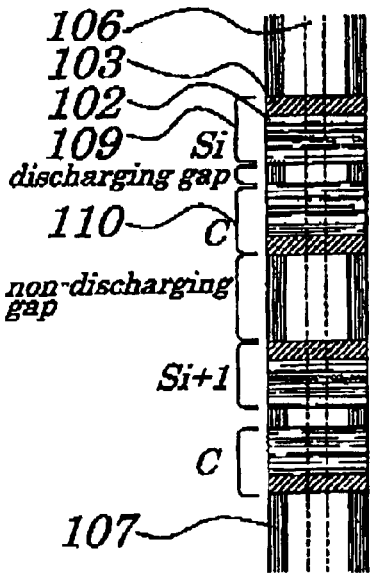
FIG.9A (PRIOR ART)
FIGS. 9A, 9B, and 9C are cross-sectional views of a main portion of the conventional Matrix-type AC-type PDP in which a first partition is provided even in a non-discharging space.
Figure 9B:
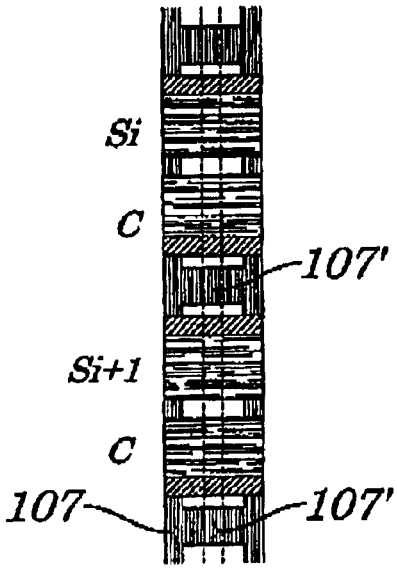
FIG.9B (PRIOR ART)
Figure 9C:
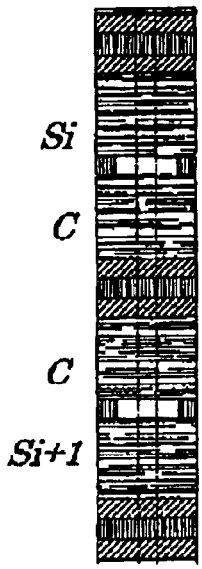
FIG.9C (PRIOR ART)

Configurations of a matrix-type AC-type PDP of a third embodiment are basically as shown in FIG. 6 and are described by referring to FIG. 6 and FIG. 7A which is a plan view of the matrix-type AC-type PDP obtained when seen from a side of its display face. The matrix-type AC-type PDP of the third embodiment is made up of insulating substrates 1*a* and 1*b*. On the insulating substrate 1*a*, a plurality of scanning electrodes 9 and a plurality of sustaining electrodes 10 are formed in such a manner that they are parallel to each other and two scanning electrodes 9 being adjacent to each other and two sustaining electrodes 10 being adjacent to each other are alternately arranged. Each of the scanning electrodes 9 and each of the sustaining electrodes 10 is made up of a bus electrode 3 used to secure its electrical conductivity in a row direction and a main discharge electrode 2 used to cause discharge to occur.

Each of the main discharge electrodes 2 has such a shape in which its width is large in a vicinity of a discharging space in a row direction, but becomes slender on its way to each of the bus electrodes 3 and that it comes in contact with each of the bus electrodes 3 with its width being slender. Charging space is provided between each of the scanning electrodes 9 and each of the sustaining electrodes 10, both of which are adjacent to each other and non-discharging space is provided between the scanning electrodes 9 and between the sustaining electrodes 10. That is, each of the main discharge electrodes 2 of each of the scanning electrodes 9 and of each of the sustaining electrodes 10 has a discharging-space-side width increasing section 11 used to increase a width on a side of the discharging space between each of the scanning electrodes 9 and each of the sustaining electrodes 10 and a non-discharging-space-side width decreasing section 12 used to reduce a width on a side of the non-discharging space between the scanning electrodes 9 and between the sustaining electrodes 10. Each of the discharging-space-side width increasing sections 11 faces each of other discharging-space-side width increasing sections 11.

The scanning electrodes 9 and the sustaining electrodes 10 are covered with a dielectric layer 4*a* and a protecting film 5 is placed on the dielectric layer 4*a* to protect the dielectric layer 4*a* from discharge, On the other hand, on the insulating substrate 1*b* are placed data electrodes 6 in such a manner that each of the data electrodes 6 and each of the scanning electrodes 9 intersect at right angles and that each of the data electrodes 6 and each of the sustaining electrodes 10 intersect at right angles. The data electrodes 6 are covered with a dielectric layer 4*b* and on the dielectric layer 4*b* are formed first partition walls 7 so as to extend in a column direction which are used to secure discharging space between the insulating substrates 1*a* and 1*b* and used to partition the display cell. In the non-discharging space, gaps are provided between the first partition walls 7 existing in the column direction and second partition walls 7' are arranged in such a manner that a width of a restriction portion of the main discharge electrodes 2 is included. On the dielectric layer 4*b* on which the first partition walls 7 and second partition walls 7' are not formed, on side faces of each of the first partition walls 7, and on side faces of each of the second partition walls 7' being arranged in the non-discharging space is applied a phosphor 8 used to convert ultraviolet rays generated by discharge into visible light. Space being put between the insulating substrates 1*a* and 1*b* and being partitioned by each of the first partition walls 7 is hermetically filled with discharging gas selected from the group consisting of helium, neon, xenon, or a like.

Figure 4B:
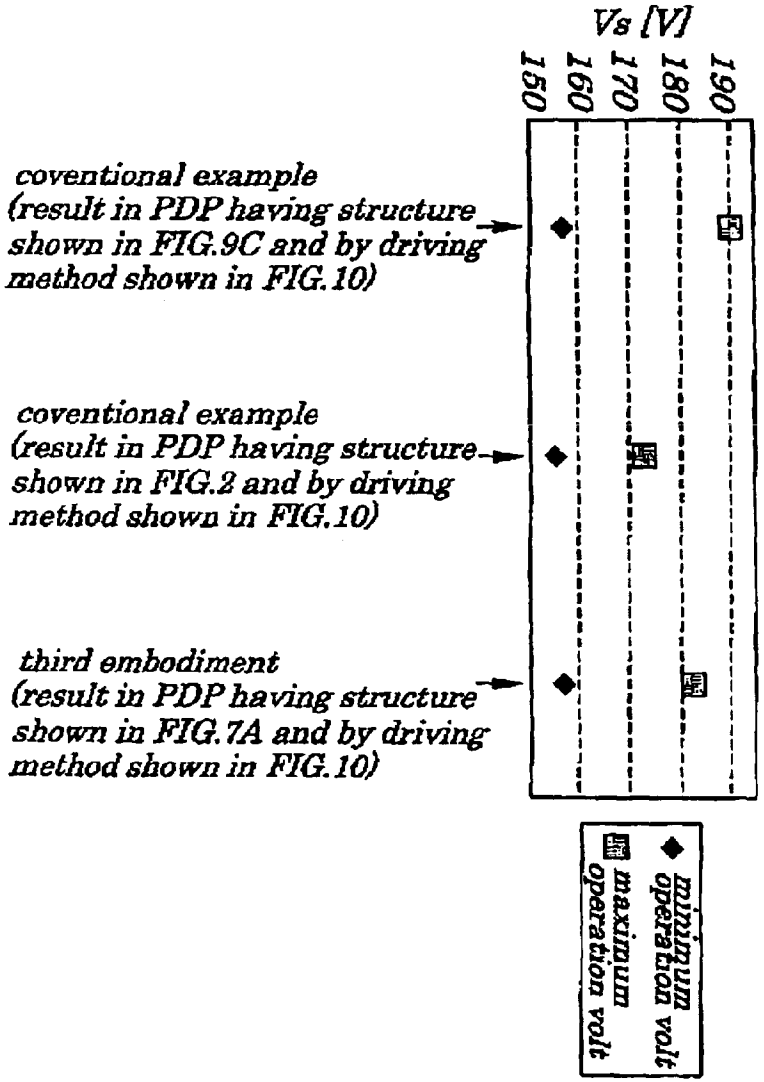

To drive the matrix-type AC-type PDP having structures of the third embodiment, a driving method employed in the conventional example shown in FIG. 10 is used. Operating range of the matrix-type AC-type PDP obtained by the driving method, as shown in FIG. 4B, is from 156 V to 182 V. The resulting operating range has been improved by about 10 V when compared with those obtained by the conventional driving method shown in FIG. 10 which ranged from 155 V to 174 V. The reason why the operating range becomes narrow by forming a groove in a transverse wall in the conventional example is that discharge leak caused by expansion of the discharge into a groove portion occurs even in display cells being adjacent to the display cells where the discharge occurs in a column direction. That is, the electrodes used to cause discharge to occur are belt-shaped in a row direction and are coupled in entire display cells existing in the row direction and therefore discharge expands in the entire electrodes thus causing the discharge to be expanded even in the groove portion and the discharge leak to occur. To solve this problem, according to the third embodiment, a shape of each of the main discharge electrodes 2 is changed to have a restriction portion as shown in FIG. 7A, that is, the non-discharging-space-side width decreasing section 12. By configuring as above, in the main discharge electrodes 2, intense discharge occurs not only in the discharging-space-side width increasing section 11 but also in the non-discharging-space-side width decreasing section 12. As a result, in a boundary section between display cells being adjacent to each other, an area in which the discharge expands can be reduced and, in the non-discharging space, by forming the second partition walls 7' having substantially the same width of the data electrodes 6 in only a path in which the discharge expands to block it, expansion of discharge can be prevented.

Though each of the main discharge electrodes 2 is in contact with each of the bus electrodes 3, since discharge grows first in the discharging space, in a position of each of the bus electrodes 2, the discharge does not grow readily in such a manner that a width of the discharge expands in the row direction. As a result, the discharge does not expand along each of the bus electrodes 2 and the discharge leak does not occur easily. By configuring as above, not only the discharge leak occurring at a time of sustaining discharge can be prevented but also the discharge leak caused by the discharge occurring between the scanning electrodes 9 and sustaining electrodes 10 at a time of writing discharge can be reduced, thus enabling operating range to be increased.

As shown in FIG. 6 and FIG. 7A, since the second partition walls 7' are arranged in such a manner that there is a gap between the first partition walls 7 and the second partition walls 7', unlike in the case where the display cells are constructed so as to be of a sealed type by the second partition walls 7' in the column direction, interception of light caused by the second partition walls 7' is relieved and its luminance is improved.

Moreover, in the case where the matrix-type AC-type PDP has a structure of a sealed-type, since almost no priming particles can be captured, the discharging delay time occurring even when display cells being adjacent to each other in the column direction and being higher in scanning order are selected is shortened only by about 0.8 times, unlike in the case where display cells being adjacent to each other in the column direction and being higher in scanning order are not selected. However, in the third embodiment, since the discharging space is connected in the column direction, priming particles can be captured from display cells being adjacent to each other in the column direction and being higher in scanning order, the discharging delay time occurring when writing discharge occurs in display cells being adjacent to each other in the column direction and being higher in scanning order is shortened by about 0.5 times, unlike in the case where display cells being adjacent to each other in the column direction and being higher in scanning order are not selected.

Moreover, in the third embodiment, the matrix-type AC-type PDP in which the two scanning electrodes 9 being adjacent to each other and two sustaining electrodes 10 being adjacent to each other are alternately arranged is used. However, the present invention is not limited to such combined arrangement of the scanning electrodes 9 and sustaining electrodes 10.

Also, in the third embodiment, as the method for driving the PDP having the structure shown in FIG. 6, the method shown in FIG. 10 is employed. However, by using the method shown in FIG. 3 in the first embodiment, or the method shown in FIG. 5 in the second embodiment, it becomes possible to inhibit the discharge leak more.

Fourth Embodiment

Configurations of a matrix-type AC-type PDP employed in a fourth embodiment are the same as those shown in FIG. 6 except main discharge electrodes 2 and the second partition walls formed in the non-discharging space and its plan view obtained when seen from a side of a displaying screen of the matrix-type AC-type PDP is the same as that provided in FIG. 7B. As shown in FIG. 7A, the second partition walls 7' existing in a row direction are so constructed that a groove is formed on both sides of each of the second partition walls 7'. However, in FIG. 7B, the second partition walls 7' are so constructed that the second partition walls 7' are integrally formed with the first partition walls 7 existing in a column direction and that a groove is formed only on one side of each of the second partition walls 7'.

Each of the main discharging electrodes 2, in the discharging space, has a discharging-space-side width increasing section 11 which extends in the row direction. However, on the way to bus electrodes 3, it has a non-discharging-space-side width decreasing section 12 so that it comes near each of the first partition walls 7 into which each of the second partition walls 7' is integrated. Each of the main discharge electrodes 2 is L-shaped as a whole. Each of the second partition walls 7' is placed in the non-discharging space in such a manner that the narrowed width is included.

To drive the matrix-type AC-type PDP having configurations described above, the conventional driving method shown in FIG. 10 is also used. In the third embodiment, intense discharge occurs in the electrode portions of the main discharging electrodes 2. Since each of the second partition walls 7' is formed in the non-discharging space in such a manner that a width of the above electrode portion is included and each of the second partition walls 7' is aligned with the non-discharging-space-side width decreasing section 12, a path into which the discharge expands can be blocked. As a result, the operating range is expanded.

Moreover, in the third embodiment, since the second partition walls 7' placed in the non-discharging space are integrally formed with the first partition walls 7 existing in the column direction, there is an advantage that the first partition walls 7 would not be broken easily.

During a scanning period, intense discharge occurs between scanning electrodes 9 and data electrodes 6. Therefore, as is apparent from configurations shown in FIG. 3C, by placing the data electrodes 6 so that they are covered with second partition walls existing in the row direction, influence of the discharge leak caused by discharge can be more reduced in this embodiment as well.

Fifth Embodiment

Configurations of a matrix-type AC-type PDP employed in a fifth embodiment are as shown in FIG. 7D which is a plan view obtained when seen from a side of its display face. In the fifth embodiment, second partition walls 7' are not formed in non-discharging space. Each of main discharge electrodes 2 has a large width in discharging space in a row direction. However, on a way to bus electrodes 3, its width becomes small. Configurations of the main discharge electrodes 2 are substantially the same as those of the main discharge electrodes 2 shown in FIG. 7B and FIG. 7C. The main discharge electrodes 2 are placed in a staggered arrangement so that a non-discharging-space-side width decreasing section 12 is not overlapped in a column direction with the non-discharging space being sandwiched. Moreover, each of data electrodes 6 is arranged at a center place between a pair of first partition walls 7.

To drive the matrix-type AC-type PDP having configurations described above, the driving method shown in FIG. 3 is used. In this embodiment, intense discharge occurs in electrode portions of the main discharge electrodes 2. By making each of the main discharge electrodes 2 narrower, expansion of the discharge can be reduced in a boundary area between display cells being adjacent each other and regions where intense discharge occurs are separated between display cells being adjacent to each other with the non-discharging space being sandwiched. Moreover, during a scanning period, since a voltage of each of sustaining electrodes 10 in the display cells being adjacent to display cells in which writing discharge occurs is reduced by Vbw2 to provide a difference in potential between the sustaining electrodes 10 being adjacent to each other, discharge leak can be reduced. As a result, operating range can be expanded in this embodiment as well.

During the scanning period, intense discharge occurs between scanning electrodes 9 and the data electrodes 6. Therefore, as is apparent from configurations shown in FIG. 7E, by placing the data electrodes 6 along the main discharge electrodes 2 so that they are not aligned straight in a column direction even in the non-discharging space, influence of discharge leak caused by discharge can be reduced.

It is apparent that the present invention is not limited to the above embodiments but may be changed and modified without departing from the scope and spirit of the invention.

What is claimed is:

1. A method for driving a matrix-type AC-type plasma display panel which is constructed by combining a first substrate having a plurality of scanning electrodes and a plurality of sustaining electrodes each extending in parallel to each other in a row direction wherein two of said scanning electrodes being adjacent to each other and two of said sustaining electrodes being adjacent to each other are alternately arranged and wherein a display line is formed between each of said scanning electrodes and each of said sustaining electrodes with a second substrate being placed so as to face a surface of said first substrate on which said scanning electrodes and said sustaining electrodes are formed and having a plurality of data electrodes extending in a column direction being orthogonal to said row direction in which said scanning electrodes and said sustaining electrodes extend and first partition walls used to partition said display line in said column direction with said data electrodes being sandwiched and by forming a plurality of display cells, each of which is placed on each point of intersection of each of said scanning electrodes, each of said sustaining electrodes, and each of said data electrodes, said method comprising:

a step of setting potentials such that, during a selecting period in which presence or absence of display about each of said display cells arranged on arbitrary one display line is controlled, a potential of said sustaining electrode making up said arbitrary one display line is different from a potential of another sustaining electrode making up another display line being adjacent to said arbitrary one display line.

2. The method for driving the matrix-type AC-type plasma display panel according to claim 1, wherein, in order to inhibit expansion of discharge occurring between said scanning electrode and said sustaining electrode according to each other, respectively belonging to said display cells arranged on said arbitrary one display line, said potential of said sustaining electrode making up said arbitrary one display line is different from said potential of another sustaining electrode making up another display line being adjacent to said arbitrary one display line.

3. The method for driving the matrix-type AC-type plasma display panel according to claim 1, wherein a scanning period during which discharge is caused to occur for selection is separated, in terms of time, from a sustaining period during which discharge is caused to occur for displaying.

4. The method for driving the matrix-type plasma AC-type display panel according to claim 3, wherein, during said scanning period, said discharge for selection is caused to occur consecutively on said display lines in order of said display lines.

5. The method for driving the matrix-type AC-type plasma display panel according to claim 3, wherein, during said scanning period, said discharge for displaying is caused to occur on said display lines in alternating lines.

6. The method for driving the matrix-type AC-type plasma display panel according to claim 1, wherein each of said scanning electrodes has a narrow electrode portion arranged on a side of a non-discharging-space between two of said scanning electrodes being adjacent to each other, and also each of said sustaining electrodes has a narrow electrode portion arranged on a side of a non-discharging-space between two of said sustaining electrodes being adjacent to each other, and wherein a second partition wall is arranged in a non-discharging space in such a manner that said second partition wall is not less than said narrow electrode portion in width is included and that discharging space is not spatially separated in said column direction by said second partition wall.

7. The method for driving the matrix-type AC-type plasma display panel according to claim 1, wherein each of said scanning electrodes has a narrow electrode portion arranged on a side of a non-discharging-space between two of said scanning electrodes being adjacent to each other, and also each of said sustaining electrodes has a narrow electrode portion arranged on a side of a non-discharging-space between two of said sustaining electrodes being adjacent to each other, and wherein said narrow electrode portions of said scanning electrode and said sustaining electrode being adjacent to each other, arranged between a pair of said first partition walls are offset each other in said column direction.

8. The method for driving the matrix-type AC-type plasma display panel according to claim 6, wherein said scanning electrodes and said sustaining electrodes are so constructed as to cover said data electrodes.

9. A matrix-type AC-type plasma display panel comprising:

a plurality of scanning electrodes extending in parallel to each other in a row direction;

a plurality of sustaining electrodes arranged in such a manner to be in parallel to said scanning electrodes and which constructs a display line in a gap between each of said sustaining electrodes and each of said scanning electrodes being adjacent to each other;

first partition walls to partition said display line in a column direction; and wherein each of said scanning electrodes and each of said sustaining electrodes has a narrow electrode portion, and wherein a second partition wall is placed between two of said narrow electrode portions adjacent to each other within a non-discharging space in such a manner that discharging space is not spatially separated in a column direction.

10. The matrix-type AC-type plasma display panel according to claim 9, wherein one said sustaining electrode is provided for every other said scanning electrode.

11. The matrix-type AC-type plasma display panel according to claim 9, wherein two of said scanning electrodes being adjacent to each other and two of said sustaining electrodes being adjacent to each other are alternately formed.

12. The matrix-type AC-type plasma display panel comprising;

a first substrate and a second substrate being placed so as to face each other;

a plurality of scanning electrodes each being placed on a surface of said first substrate which faces said second substrate and extending in parallel to each other in said row direction;

a plurality of sustaining electrodes arranged in such a manner to be in parallel to said scanning electrodes and each constructing a display line in a gap between each of said sustaining electrodes and each of said scanning electrodes both being adjacent to each other;

a plurality of data electrodes being placed on a surface of said second substrate which faces said first substrate and extending in said column direction orthogonal to a direction in which each of said scanning electrodes and each of said sustaining electrodes extend;

partition walls used to partition said display line in said column direction;

a plurality of display cells, each of which is placed at each point of intersection of each of said scanning electrodes, each of said sustaining electrodes, and each of data electrodes; and second partition walls being placed between said display lines in such a manner to cover each of said data electrodes.

13. The matrix-type AC-type plasma display panel according to claim 12, wherein one said sustaining electrode is provided for every other said scanning electrode.

14. The matrix-type AC-type plasma display panel according to claim 12, wherein two of said scanning electrodes being adjacent to each other and two of said sustaining electrodes being adjacent to each other are alternately formed.

* * * * *